US006523477B1

(12) United States Patent
Brooks et al.

(10) Patent No.: US 6,523,477 B1
(45) **Date of Patent: *Feb. 25, 2003**

(54) ENHANCED PERFORMANCE INSENSITIVE PENETRATOR WARHEAD

(75) Inventors: George W. Brooks, Orlando, FL (US); Eric E. Roach, Orlando, FL (US)

(73) Assignee: Lockheed Martin Corporation, Bethesda, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,538

(22) Filed: Mar. 30, 1999

(51) Int. Cl.[7] ..... F41A 9/00; C06B 29/22

(52) U.S. Cl. ..... 102/481; 149/76; 149/109.4; 149/108.6; 102/517; 102/518

(58) Field of Search ..... 102/481, 364, 102/517–519

(56) References Cited

U.S. PATENT DOCUMENTS

| | | | | | |
|---|---|---|---|---|---|
| 1,562,495 | A | * | 11/1925 | Dalton | 102/519 |
| 2,402,811 | A | * | 6/1946 | Galen | 102/364 |
| 3,793,097 | A | * | 2/1974 | Lawrence | 149/5 |
| 4,040,880 | A | | 8/1977 | Rothenstein et al. | |
| 4,072,702 | A | * | 2/1978 | Huskins | 260/453 |
| 4,116,734 | A | | 9/1978 | Perrault et al. | |
| 4,289,551 | A | * | 9/1981 | Perrault et al. | 149/19.4 |
| 4,295,425 | A | * | 10/1981 | Davis | 102/326 |
| 4,397,240 | A | * | 8/1983 | Rottenberg et al. | 102/376 |
| 4,648,324 | A | * | 3/1987 | McDermott | 102/518 |
| 4,685,597 | A | * | 8/1987 | Hirao et al. | 222/389 |
| 5,020,731 | A | | 6/1991 | Somoza et al. | |
| 5,038,686 | A | | 8/1991 | Zulkoski et al. | |
| 5,254,186 | A | * | 10/1993 | Downes et al. | 149/47 |
| 5,411,615 | A | * | 5/1995 | Sumrail et al. | 149/47 |
| 5,468,313 | A | * | 11/1995 | Wallace et al. | 149/53 |
| 5,507,891 | A | * | 4/1996 | Zeigler | 149/47 |
| 5,786,544 | A | | 7/1998 | Gill et al. | |
| 5,939,662 | A | * | 8/1999 | Bootes et al. | 102/473 |
| 5,976,293 | A | * | 11/1999 | Olander et al. | 156/172 |
| 5,996,501 | A | * | 12/1999 | Spencer et al. | 102/286 |
| 6,105,505 | A | * | 8/2000 | Jones | 102/364 |

FOREIGN PATENT DOCUMENTS

| | | | | |
|---|---|---|---|---|
| DE | 2 226 718 | | 12/1972 | |
| DE | 3904625 | * | 8/1990 | 102/518 |
| EP | 0 323 828 | | 7/1989 | |

OTHER PUBLICATIONS

Military Standard, MIL–STD–2105A, Sep. 9, 1982.

* cited by examiner

*Primary Examiner*—Michael J. Carone
*Assistant Examiner*—Lulit Semunegus
(74) *Attorney, Agent, or Firm*—Burns, Doane, Swecker & Mathis, LLP

(57) ABSTRACT

A warhead assembly includes a penetrating casing having a forward nose portion and an generally cylindrical aft portion opposite said nose portion. A closure ring is disposed in said aft portion, a vent also being provided in said aft portion. The warhead casing is filled with a predetermined level of explosive material. Preferably the explosive composition contain reduced amounts of explosive material and a strong oxidizer. The warhead assembly possesses superior penetration and blast performance, as well as superior Insensitive Munitions characteristics.

45 Claims, 4 Drawing Sheets

200
A
218
220
212
202
228
226
204
216
222
211
210
206
214
208
224

ENHANCED PERFORMANCE INSENSITIVE PENETRATOR WARHEAD

BACKGROUND OF THE INVENTION

1. Field of the Invention

The present invention relates to an improved projectile construction. In particular, the present invention relates to an improved penetrator warhead assembly having enhanced target-defeating capabilities, as well as improved insensitive munitions characteristics.

2. State of the Art

Implementing an effective penetrating projectile, such as a warhead, often involves balancing competing factors. A warhead should have adequate penetration, blast and fragmentation properties in order to effectively destroy the intended target. Targets that are difficult to defeat, such as buried or fortified targets, require a high degree of warhead penetration in order to be destroyed. The penetrability of a warhead can be increased by modifying the shape and strength of the nose section, as well as increasing the overall wall thickness of the warhead. As a result of such modifications, the payload volume of the warhead is decreased. Therefore to maintain the same degree of blast performance in such modified warheads, a smaller quantity of explosive payload material must be used that is capable of producing the same explosive performance as larger quantities of explosive.

Another important objective in warhead design is the ability to control detonation of explosive payloads carried by the warhead so as to avoid accidental of premature explosion of the warhead. In this regard, the military has increasingly demanded that contractors develop weapons systems that are less volatile and therefore less likely to explode unintentionally. These requirements are often referred to as "Insensitive Munitions" (IM) requirements and are set forth in military standard MIL-STD-2105.

Warheads that have favorable IM characteristics are not only safer to handle, but are also relatively more effective in defeating targets that are hard to penetrate since detonation of the explosive payload of the warhead can be more precisely controlled, thereby delaying detonation until the warhead has adequately penetrated the target.

Accordingly, it would be desirable to provide a warhead assembly that has good penetrability and blast performance, while also having enhanced IM characteristics.

SUMMARY OF THE INVENTION

The present invention is directed to providing warhead assemblies which are constructed to achieve optimal target penetration and destruction capabilities, as well as having favorable IM characteristics which render the warhead assembly safer and easier to more precisely control detonation. In exemplary embodiments, a warhead assembly of the present invention has penetration performance comparable with known warhead configurations such as the BLU-109 warhead, and blast performance comparable with the known Mark 83 bomb. The warhead assembly also conforms with certain IM standards as set forth in MIL-STD-2105.

Generally speaking, exemplary embodiments are directed to a warhead assembly including a warhead casing having a substantially ogive-shaped nose portion, a substantially cylindrical aft portion at an end of the warhead opposite from the nose portion, and a vent disposed along said aft portion of said warhead assembly.

Other exemplary embodiments of the present invention are directed to a warhead assembly having a warhead casing including a vented aft end portion, the casing being filled to a predetermined level with an explosive material, and the warhead assembly being constructed such that it will not explode when subjected to fast cook-off conditions.

Further exemplary embodiments of the present invention are directed to a warhead casing which comprises an ogive-shaped end portion, and a substantially cylindrically-shaped aft end portion at an end of the warhead opposite from a nose portion, a bore formed in the aft end portion, an aft closure ring fitted within the bore, and a vent disposed within the aft closure ring. The casing is filled to a predetermined level with an explosive material, the explosive material having a composition including:

| component | Min. Amount (weight %) | Max. Amount (weight %) |
|---|---|---|
| RDX (4$\mu$) | 19.0 | 21.0 |
| RDX Class I | 4.0 | 6.0 |
| Ammonium Perchlorate | 29.0 | 32.0 |
| Aluminum | 32.0 | 35.0 |
| Poly BD | 4.44 | 4.44 |
| Dioctyl Adipate | 6.56 | 6.56 |
| Isophorone Diisocyanate | 0.45 | 0.45 |
| Lecithin | 0.30 | 0.50 |
| Triphenyl Bismuth | 0.01 | 0.30 |
| Ethyl-702 | 0.04 | 0.06 |

(% Solids = % RDX + % AP + % Al)

BRIEF DESCRIPTION OF THE DRAWINGS

Other objects and advantages of the present invention will become more apparent to those skilled in the art from reading the following detailed description of preferred embodiments in conjunction with the accompanying drawings, wherein like elements have been designated with like reference numerals, and wherein.

DETAILED DESCRIPTION OF THE PREFERRED EMBODIMENTS

Figure 1:
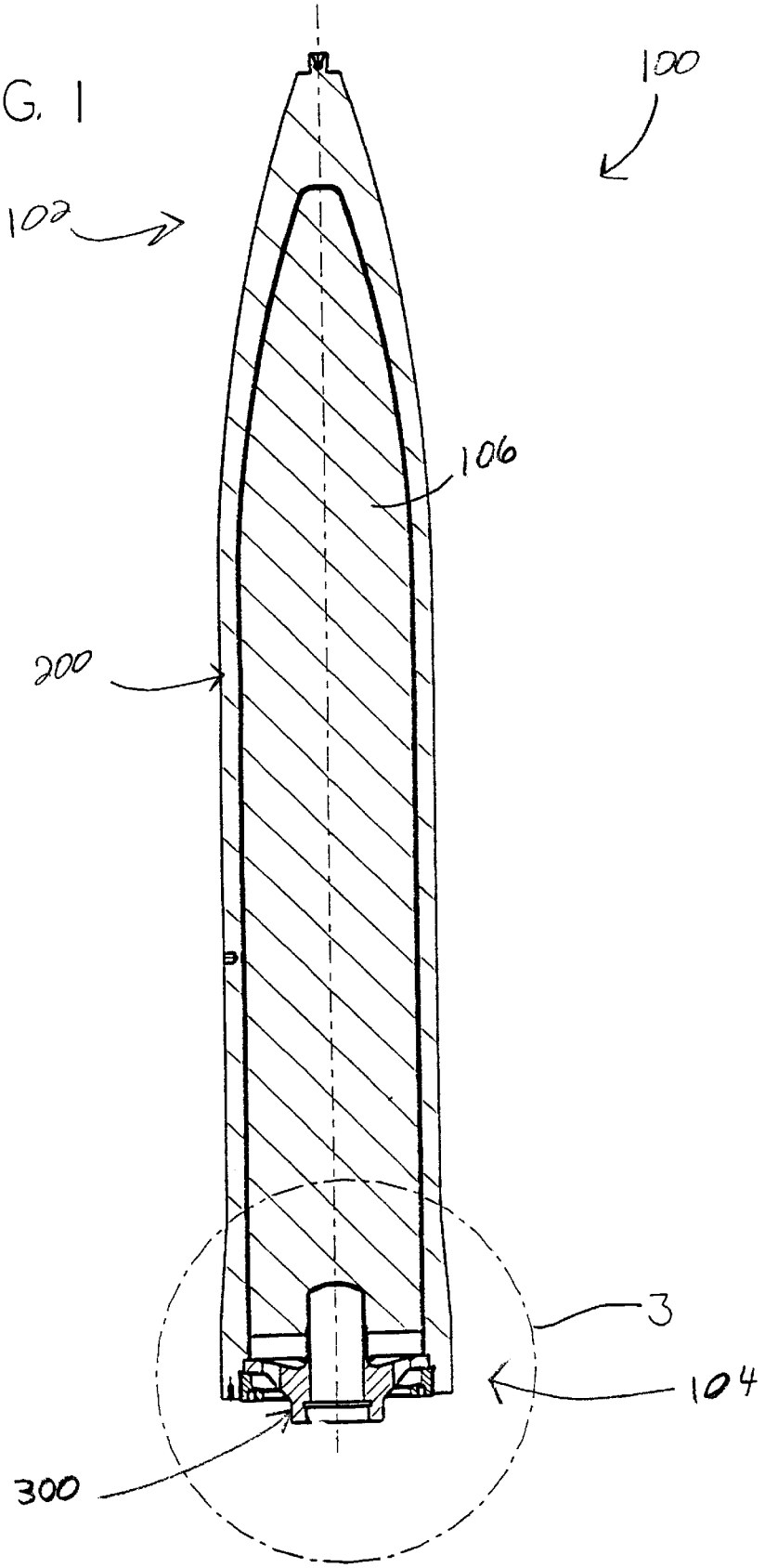
FIG. 1 is a longitudinal cross-sectional view of a warhead assembly constructed according to an exemplary embodiment of the present invention.

FIG. 1 illustrates an exemplary warhead assembly 100 constructed according to principles of the present invention. The warhead assembly 100 has a longitudinal axis A and includes a forward end portion 102. An aft end portion 104 is located at the end of the warhead assembly 100 opposite the forward end portion 102. The warhead assembly 100 includes warhead casing 200 which contains an explosive material payload 106. The aft end portion 104 of the warhead assembly 100 includes an aft closure ring assembly 300.

Figure 2:
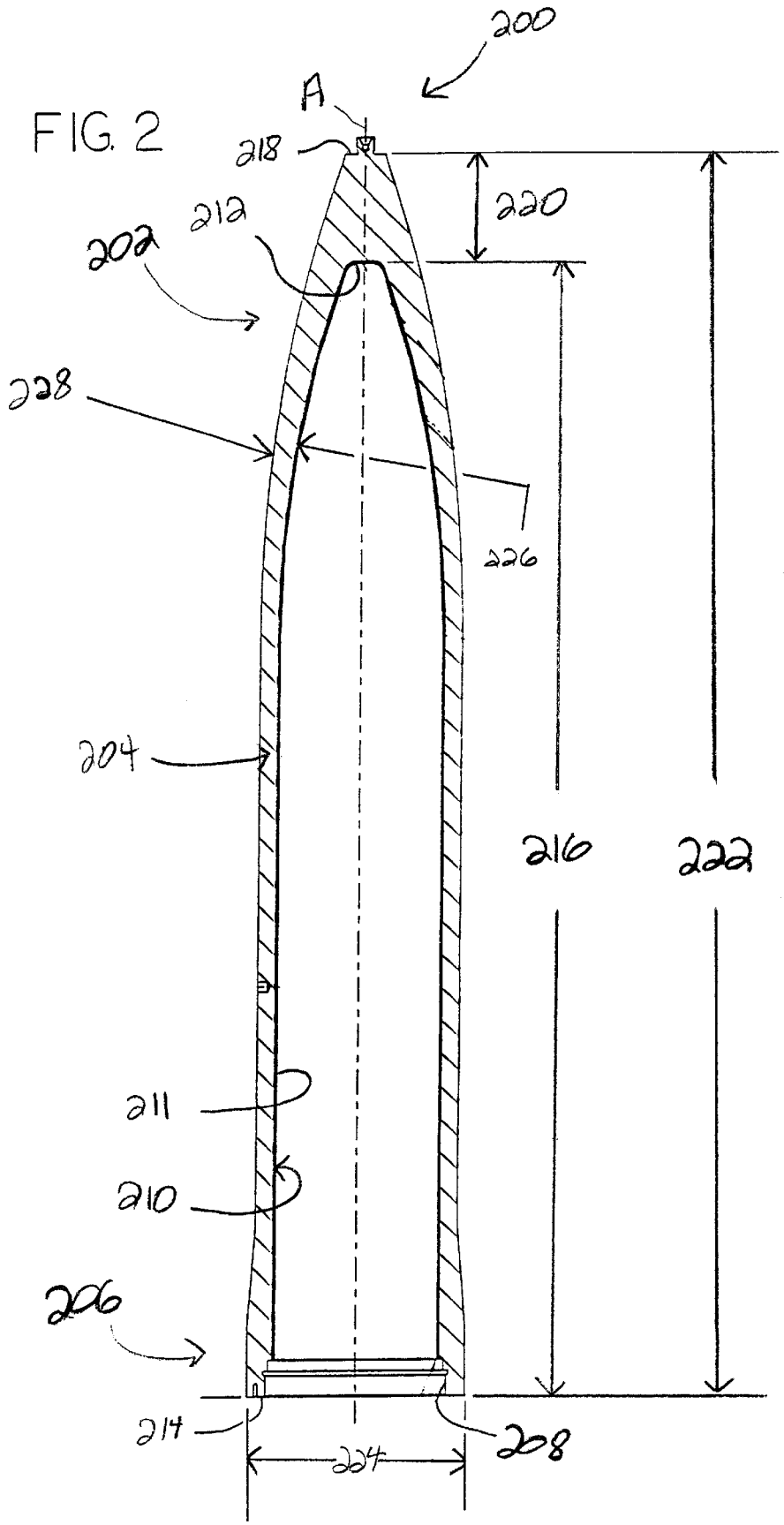
FIG. 2 is a longitudinal cross-sectional view of the warhead casing of FIG. 1.

Referring to FIG. 2, the warhead casing 200 comprises a substantially ogive-shaped nose portion 202 having a forward exterior end surface 218, a cylindrical body portion 204, and an aft end portion 206.

A bore 208 is formed in the aft end portion 206. The bore 208 forms a large opening in the aft end portion 206 of the warhead casing 200, thereby facilitating filling of the interior or payload section of the warhead casing 200 with explosives or other payload materials. A rear exterior end surface is also defined at the aft end portion 206.

An interior surface 210 of the warhead casing 200 defined the payload section. In one embodiment, the interior surface 210 is coated with an asphaltic compound 211. One such suitable compound is specified in military standard MIL-C-3301. A forward interior end surface 212 is also defined along the interior surface 210.

The weight and dimensions of the warhead casing can vary, depending upon the target scenario against which the warhead is intended to be utilized, among other factors. In one embodiment of the present invention, the warhead has a weight on the order of 650 lbs. Exemplary dimensions are as follows:

| Dimension | Approximate Value (inches) |
|---|---|
| 216 - Longitudinal length between forward interior end surface 212 and rear exterior end surface 214. | 64.61–64.08 |
| 220 - Longitudinal distance between forward interior end surface 212 and forward exterior end surface 218. | 6.53–5.94 |
| 222 - Longitudinal distance between forward exterior end surface 218 and rear exterior end surface 214. | 70.61–70.55 |
| 224 - Outer diameter of warhead casing at aft end portion 206. | 12.65–12.35 |
| 226 - Internal radius of curvature along ogive-shaped nose portion 202. | 60.01–59.99 |
| 228 - External radius of curvature along ogive-shaped nose portion 202. | 81.01–80.99 |

By constructing a warhead casing having a shape according to the present invention a high degree of penetration of the target can be achieved. Target penetration of the warhead of the present invention is comparable with, for example, a conventional BLU-109 warhead.

Warhead casing 200 can be constructed of any suitable high strength material. In preferred embodiments, the warhead casing 200 is constructed of a high strength steel alloy. By way of example, one such alloy is AISI 4335 steel alloy.

Figure 3:
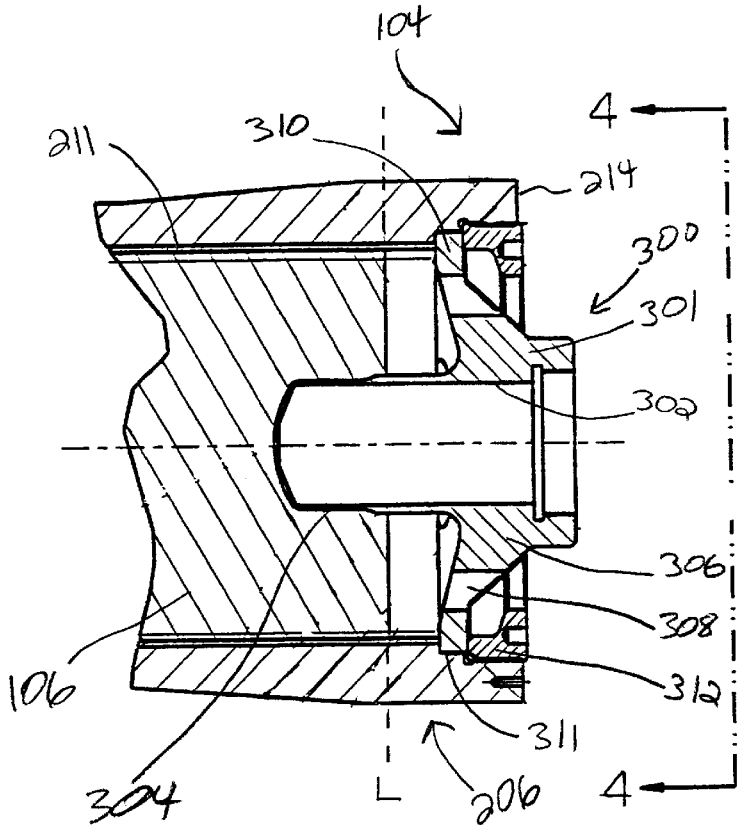
FIG. 3 is an enlarged partial cross-sectional view of the aft closure ring assembly of FIG. 1.
Figure 4:
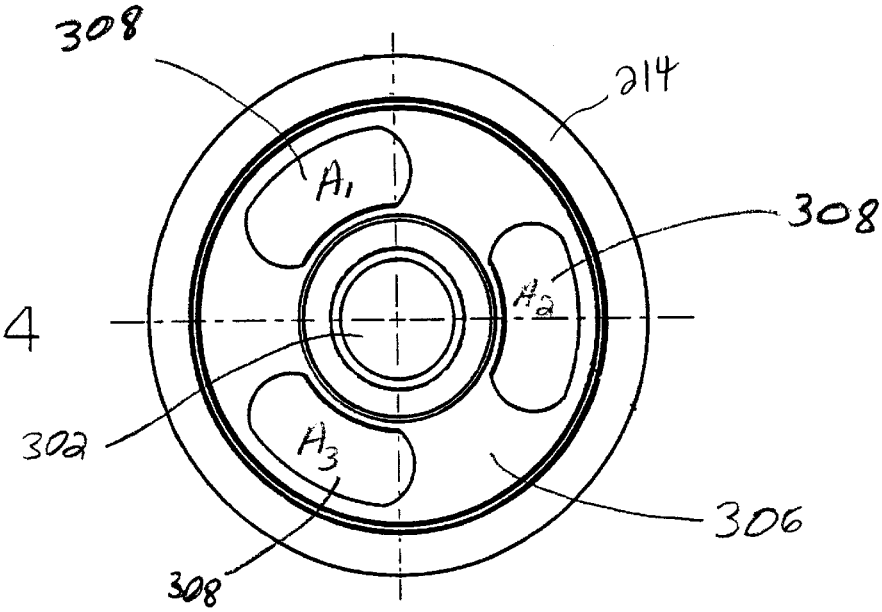
FIG. 4 is an end view along line 4—4 of FIG. 3.

As illustrated in FIGS. 3 and 4, the aft end portion 206 of the warhead casing 200 is closed by an aft closure ring assembly 300 that is received within bore 208. The aft ring closure assembly 300 comprises an aft closure ring 301 and an aft closure retaining ring 312.

Aft closure ring 301 includes a central bore 302 and fuze liner 304. A fuze (not shown) of any suitable conventional construction is inserted into central bore 302 and housed by fuze liner 304. In the illustrated embodiment, aft closure ring 301 includes a solid hub portion 306 with vent openings 308 disposed therein. Three such openings 308 are illustrated, each opening defining an open area $A_1$, $A_2$, and $A_3$. Aft closure ring 301 further includes an outer mounting flange 310 that is received on a shoulder 311 of the bore 208.

Aft closure retaining ring 312 is threadably received within the bore 208 and is tightened so as to engage outer mounting flange 310 and thereby retain aft closure ring 301 in its proper position.

When assembling the aft closure ring 301 and aft closure retaining ring 312, it is desirable to cover the mating surfaces of the warhead casing 200, closure ring 301 and retaining ring 312 with a petrolatum sealant in order to prevent unwanted leakage from the payload section of the warhead casing 200.

The aft closure ring assembly 300 of the present invention provides several key advantages. Providing the aft closure ring assembly with a structure for venting the interior explosive payload section of the warhead assembly 100 allows the explosive material 106 to "cook-off" in the event that the warhead is exposed to heat or flame. In other words, instead of being trapped inside warhead casing 200, reacted explosive material can be expelled from the interior of the warhead casing 200. In this manner the warhead is less prone to accidental or unintentional explosions, and the IM performance is improved.

In the illustrated embodiment, the venting structure is in the form of oblong circumferentially spaced openings 308. However, several alternative venting structures are comprehended by scope of the present invention.

For example, the openings may be differently shaped and in different numbers than the illustrated embodiment. Where venting is to be provided by openings formed in the aft closure ring 301, the size, shape, and number of such openings are determined based upon potentially competing factors.

First, the required amount of venting is affected by the rate at which the explosive material 106 reacts when subjected to heat and/or flame. Clearly, a larger total venting area will be advantageous in satisfying this first factor. One way of characterizing this first factor is with the ratio of total venting area over the total exposed exterior surface area of the explosive ($VA_T/XSA_T$). This ratio can be referred to a the ratio of vent area to burn area. By way of example, in the illustrated embodiment the open area of each individual vent opening 308 is 7.24 $in^2$, thereby giving a total venting area of $(A_1+A_2+A_3)=21.7$ $in.^2$. The total exposed external surface area of the explosive contained within the warhead casing 200 is 79.49 $in^2$. The ratio $VA_T/XSA_T=0.273$ and provides beneficial venting performance.

A second competing factor that must be considered in the design of the aft closure ring assembly 300 is the structural integrity that must be possessed by the aft closure ring 301 in order to survive impact with target. Structural integrity is required so that penetration and detonation is not adversely effected. Clearly, the larger the total vent area opening in the aft closure ring 301, the more the structural integrity is adversely effected. While the appropriate structural integrity may be determined through impact testing, the use of commercially available software such as SAMPLL™ or NASTRAN™ may also be used to analyze the structural strength of a particular aft retainer ring assembly 300 design mounted in case 200.

By providing an aft ring assembly 300 constructed in accordance with the principles of the present invention, both adequate venting and structural integrity can be achieved thereby improving overall warhead performance and IM characteristics.

Figure 5:
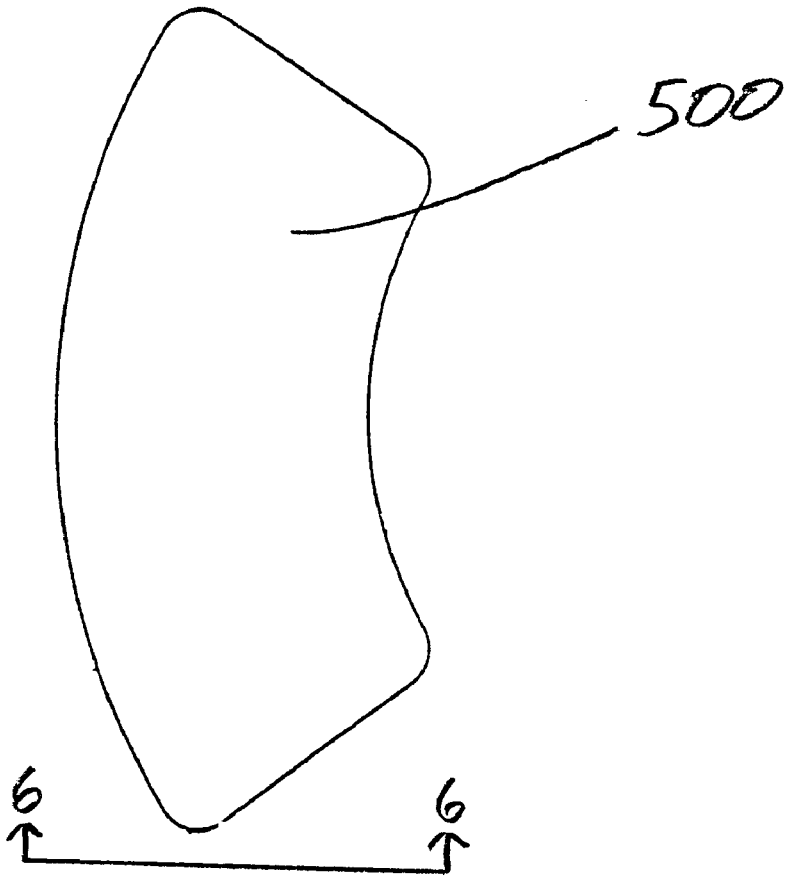
FIG. 5 is a plan view of a vent opening seal member.
Figure 6:
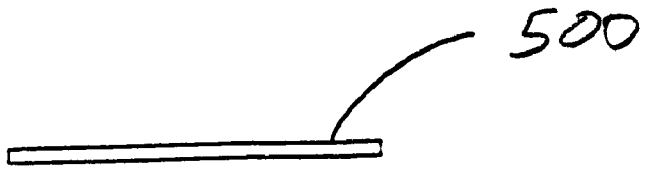
FIG. 6 is an end view of the vent opening seal member along line 6—6 of FIG. 5.

In one embodiment of the present invention, the vent openings 308 are each sealed or covered by an appropriate sealing member. One such member 500 is illustrated in FIGS. 5–6. Vent seal 500 is constructed as a thin strip that has a shape roughly the same as the vent openings 308. Vent seal 500 is sized so as to be somewhat larger in area than each of the vent openings 308. Vent seal 500 can be formed of any suitable material, such as an insulative polymeric material. One such material is described in military specification MIL-I-23053/5. The vent seal members 500 are preferably fitted over each vent seal opening 308, then adhesively bonded to solid hub potion 306 of aft closure ring 301. Upon exposure to sufficient amounts of heat and/or flame, vent seals 500 thermally degrade thereby clearing the vent seal openings 308 to permit "cook-off" or venting from the interior of the warhead casing 200.

While the above description of venting has centered around openings formed in the aft closure ring 301, other constructions are contemplated by the present invention to achieve this result. For example, at least one closure could be provided in the aft closure ring assembly 300 which is opened automatically upon exposure to a predetermined temperature, in essence acting as a thermally activated valve.

As previously noted the warhead casing 200 is filled to a predetermined level "L" see FIG. 3) with an explosive material 106. Consistent with the principles of the present invention, any explosive material which possesses both good blast performance as well as good IM characteristics could be utilized. By way of example, one such explosive shown to possess the desired properties is designated as Air Force explosive AFX-757. In one embodiment of the present invention, a somewhat modified form of the nominal AFX-757 is used as explosive material 106 and has the following approximate composition:

| Component | Exemplary Amount (wt. %) | Min. Amount (weight %) | Max. Amount (Weight %) | Function |
|---|---|---|---|---|
| RDX* (4$\mu$) | 20.00 | 19.0 | 21.0 | High Explosive |
| RDX* Class I | 5.00 | 4.0 | 6.0 | High Explosive |
| Ammonium Perchlorate (AP-200$\mu$) | 30.00 | 29.0 | 32.0 | Oxidizer |
| Aluminum (17$\mu$) | 33.00 | 32.0 | 35.0 | Metal Fuel |
| Polybutadiene, Liquid, Hydroxl-Terminated, Type II (Poly BD) | 4.44 | — | — | Polymer |
| Dioctyl Adipate (DOA) | 6.56 | — | — | Plasticizer |
| Isophorone Diisocyanate (IPDI) | 0.45 | — | — | Crosslinker |
| Lecithin (Liquid) | 0.40 | 0.30 | 0.50 | Wetting Agent |
| Triphenyl Bismuth (TPB) | 0.10 | 0.01 | 0.30 | Catalyst |
| Ethyl-702 | 0.05 | 0.04 | 0.06 | Antioxidant |

(* = as set forth in military specification MIL-R-398)

An explosive having the above composition uses a reduced amount of explosive component in order to improve IM characteristics and prevent premature explosion upon impact with the target, but includes a strong oxidizer, which drives the explosive to a very complete reaction, thereby increasing blast performance. The above composition also provides for acceptable cure times and processing characteristics. In terms of performance, the above explosive composition has shown an increase in blast performance on the order of 38%, and a reduction in materials costs on the order of 20%, when compared with other standard explosive compositions, (e.g.—TRITONAL and PBXN-109), while also providing enhanced IM characteristics.

By providing the warhead assembly 100 with the combination of features set forth above, superior IM characteristics, as well as target destruction capabilities, are obtained.

The requirements for certification under the military's Insensitive Munitions guidelines are set forth in military standard MIL-STD-2105. One indicator of Insensitive munitions characteristics is performance during a "fast cook-off" test. Under this test a warhead assembly loaded with an explosive is subjected to high temperatures over a specified period of time. The test is "passed" if the explosive material does not explode.

A loaded warhead assembly 100 constructed according to the above description was suspended 36 inches above a container 28 ft. in diameter and 4 inches deep housing 1200 gallons of JP-8 fuel with 40 gallons of high-octane gasoline. The gasoline was ignited at four different locations. The temperature rose to approximately 1600° F. in about 12 seconds, rapidly rose to approximately 1800° F., then fell again to approximately 1600° F. for the remainder of the test. The fuel burned for approximately 35 minutes. No evidence of explosion was observed.

In terms of target destruction capabilities, a warhead assembly 100 constructed according to the present invention achieves superior penetration and blast performance. For example, a warhead assembly of the present invention can be configured with penetration performance comparable with the BLU-109 warhead or better, and blast performance comparable with the Mark 83 bomb or both.

The invention has been described above in terms of specific embodiments merely for the sake of elucidation. No statement above is intended to imply that the above embodiments are the only fashion in which the invention may be embodied or practiced, and no statement above should be so construed. To the contrary, it will be readily apparent to one of ordinary skill in the art that it is possible to conceive of many embodiments not described above which nevertheless embody the principles and teaching of the invention. The invention should therefore not be limited to what is described above, but instead should be regarded as being fully commensurate in scope with the following claims.

What is claimed is:

1. A warhead assembly comprising:

a penetrating warhead casing, said casing comprises an ogive-shaped end portion, and a substantially cylindrically-shaped aft end portion at an end of the warhead opposite from said nose portion, a bore formed in said aft end portion;

an aft closure ring fitted within said bore, and a vent disposed within said aft closure ring; and said casing filled to a predetermined level with an explosive material, said explosive material having a composition comprising:

| component | Min. Amount (weight %) | Max. Amount (Weight %) |
|---|---|---|
| RDX (4μ) | 19.0 | 21.0 |
| Ammonium Perchlorate | 29.0 | 32.0 |
| Aluminum | 32.0 | 35.0 |
| Poly BD | 4.44 | 4.44 |
| Dioctyl Adipate | 6.56 | 6.56 |
| Isophorone Diisocyanate | 0.45 | 0.45 |
| Lecithin | 0.30 | 0.50 |
| Triphenyl Bismuth | 0.01 | 0.30 |

2. The warhead assembly of claim 1, wherein said vent comprises at least one opening in said aft closure ring, the total area of said at least one opening being approximately 21.7 $in^2$.

3. The warhead assembly of claim 2, wherein said vent comprises a plurality of circumferentially-spaced openings.

4. The warhead assembly of claim 3, wherein there are three circumferentially-spaced openings.

5. The warhead assembly of claim 1, wherein said warhead assembly further comprises an aft closure retaining ring threadably received within said bore which retains said aft closure ring.

6. The warhead assembly of claim 5, wherein a thin layer of petrolatum sealant is applied along mating surfaces between said aft closure ring and said casing, and along mating surface between said retaining ring and said casing and between said retaining ring and said aft closure ring.

7. The warhead assembly of claim 1, further comprising an interior surface extending from the aft end portion including a forward interior end surface defining an explosive payload receiving section; and the explosive material contained in the payload receiving section of the warhead casing and disposed along the interior surface.

8. The warhead assembly of claim 1, wherein the warhead assembly is constructed such that it will not explode when subjected to fast cook-off conditions comprising:

suspending the warhead assembly above a container of flammable fuel;

igniting the flammable fuel; and exposing the suspended warhead assembly to an average flame temperature of at least 1600° F. for a period of time of at least 35 minutes.

9. The warhead assembly of claim 1, wherein said vent comprises at least one opening defining a vent opening area, said explosive material defining a total external explosive surface area, and the ratio of vent opening area to total external explosive area is approximately 0.27.

10. A warhead assembly comprising:

a penetrating warhead casing comprising a vented aft end portion;

said casing filled to a predetermined level with an explosive material, the explosive material having a composition comprising the following constituents, in weight percent:

| component | Min. Amount (weight %) | Max. Amount (Weight %) |
|---|---|---|
| RDX (4μ) | 19.0 | 21.0 |
| Ammonium Perchlorate | 29.0 | 32.0 |

-continued

| component | Min. Amount (weight %) | Max. Amount (Weight %) |
|---|---|---|
| Aluminum | 32.0 | 35.0 |
| Poly BD | 4.44 | 4.44 |
| Dioctyl Adipate | 6.56 | 6.56 |
| Isophorone Diisocyanate | 0.45 | 0.45 |
| Lecithin | 0.30 | 0.50 |
| Triphenyl Bismuth | 0.01 | 0.30; |

and said vented aft end portion constructed, and the composition of said explosive material chosen, such that it will not explode when subjected to fast cook-off conditions comprising:

suspending the warhead assembly above a container of flammable fuel;

igniting the flammable fuel; and exposing the suspended warhead assembly to an average flame temperature of at least 1600° F. for a period of time of at least 35 minutes.

11. The warhead assembly of claim 10, wherein:

said casing comprises an ogive-shaped end portion, and a substantially cylindrically-shaped aft end portion at an end of the warhead assembly opposite from said nose portion, a bore formed in said aft end portion; and an aft closure ring fitted within said bore, and a vent disposed within said aft closure ring.

12. The warhead assembly of claim 10, wherein said vent comprises at least one opening in said aft closure ring, the total area of said at least one opening being approximately 21.7 $in^2$.

13. The warhead assembly of claim 11, wherein said vent comprises a plurality of circumferentially-spaced openings.

14. The warhead assembly of claim 13, wherein there are three circumferentially-spaced openings.

15. The warhead assembly of claim 11, wherein said warhead assembly further comprises an aft closure retaining ring threadably received within said bore which retains said aft closure ring within said bore.

16. The warhead assembly of claim 15, wherein a thin layer of petrolatum sealant is applied along mating surfaces between said aft closure ring and said casing, and along mating surface between said retaining ring and said casing and between said retaining ring and said aft closure ring.

17. The warhead assembly of claim 10, wherein said vent comprises at least one opening defining an vent opening area, said explosive defining a total external explosive surface area, and the ratio of vent opening area to total external explosive area is approximately 0.27.

18. The warhead assembly of claim 10, further comprising the warhead casing having a substantially ogive-shaped nose portion, and an interior surface extending from the aft end portion including a forward interior end surface defining an explosive payload receiving section; and the explosive material contained in the payload receiving section of the warhead casing and disposed along the interior surface.

19. A warhead assembly comprising: a penetrating warhead casing having a substantially ogive-shaped nose portion, an aft end portion, an interior surface extending from the aft end portion including a forward interior end surface defining an explosive payload receiving section; an explosive material contained in the payload receiving section of the warhead casing and disposed along the interior surface; a bore formed in said aft end portion; an aft closure ring fitted within said bore, and a vent disposed within said aft closure ring; and wherein the explosive material includes the following constituents, in weight percent: 23.0–27.0% high explosive, 29.0–32.0% oxidizer, 32.0–35.0% metal fuel, 0.30–0.50% wetting agent, 0.01–0.30% catalyst, and 0.04–0.06% antioxidant.

20. The warhead assembly of claim 19, wherein said vent comprises at least one opening in said aft closure ring, the total area of said at least one opening being approximately 21.7 $in^2$.

21. The warhead assembly of claim 20, wherein said vent comprises a plurality of circumferentially-spaced openings.

22. The warhead assembly of claim 21, wherein there are three circumferentially-spaced openings.

23. The warhead assembly of claim 19, wherein said warhead assembly further comprises an aft closure retaining ring threadably received within said bore which retains said aft closure ring.

24. The warhead assembly of claim 23, wherein a thin layer of petrolatum sealant is applied along mating surfaces between said aft closure ring and said casing, and along mating surface between said retaining ring and said casing and between said retaining ring and said aft closure ring.

25. The warhead assembly of claim 19, wherein said vent comprises at least one opening defining a vent opening area, said explosive defining a total external explosive surface area, and the ratio of vent opening area to total external explosive area is approximately 0.27.

26. The warhead assembly of claim 19, wherein said composition further comprises:

| component | Min. Amount (weight %) | Max. Amount (Weight %) |
|---|---|---|
| RDX (4$\mu$) | 19.0 | 21.0 |
| RDX Class I | 4.0 | 6.0 |
| Ammonium Perchlorate | 29.0 | 32.0 |
| Aluminum | 32.0 | 35.0 |
| Poly BD | 4.44 | 4.44 |
| Dioctyl Adipate | 6.56 | 6.56 |
| Isophorone Diisocyanate | 0.45 | 0.45 |
| Lecithin | 0.30 | 0.50 |
| Triphenyl Bismuth | 0.01 | 0.30 |

27. The warhead assembly of claim 19, wherein the warhead assembly is constructed such that it will not explode when subjected to fast cook-off conditions comprising:

suspending the warhead assembly above a container of flammable fuel;

igniting the flammable fuel; and exposing the suspended warhead assembly to an average flame temperature of at least 1600° F. for a period of time of at least 35 minutes.

28. The warhead assembly of claim 21, wherein the warhead assembly is constructed such that it will not explode when subjected to fast cook-off conditions comprising:

suspending the warhead assembly above a container of flammable fuel;

igniting the flammable fuel; and exposing the suspended warhead assembly to an average flame temperature of at least 1600° F. for a period of time of at least 35 minutes.

29. A warhead assembly comprising: a penetrating warhead casing comprising a vented aft end portion; said casing filled to a predetermined level with an explosive material; and said vented aft end portion constructed, and the composition of said explosive material chosen, such that it will not explode when subjected to fast cook-off condition comprising: suspending the warhead assembly above a container of flammable fuel; igniting the flammable fuel; exposing the suspended warhead assembly to an average flame temperature of at least 1600° F. for a period of time of at least 35 minutes; and wherein the explosive material includes the following constituents, in weight percent: 23.0–27.0% high explosive, 29.0–32.0% oxidizer, 32.0–35.0% metal fuel, 0.30–0.50% wetting agent, 0.01–0.30% catalyst, and 0.04–0.06% antioxidant.

30. The warhead assembly of claim 29, wherein:

said casing comprises an ogive-shaped end portion, and a substantially cylindrically-shaped aft end portion at an end of the warhead assembly opposite from said nose portion, a bore formed in said aft end portion; and an aft closure ring fitted within said bore, and a vent disposed within said aft closure ring.

31. The warhead assembly of claim 29, wherein said vent comprises at least one opening in said aft closure ring, the total area of said at least one opening being approximately 21.7 $in^2$.

32. The warhead assembly of claim 30, wherein said vent comprises a plurality of circumferentially-spaced openings.

33. The warhead assembly of claim 32, wherein there are three circumferentially-spaced openings.

34. The warhead assembly of claim 30, wherein said warhead assembly further comprises an aft closure retaining ring threadably received within said bore which retains said aft closure ring within said bore.

35. The warhead assembly of claim 34, wherein a thin layer of petrolatum sealant is applied along mating surfaces between said aft closure ring and said casing, and along mating surface between said retaining ring and said casing and between said retaining ring and said aft closure ring.

36. The warhead assembly of claim 29, wherein said vent comprises at least one opening defining an vent opening area, said explosive defining a total external explosive surface area, and the ratio of vent opening area to total external explosive area is approximately 0.27.

37. The warhead assembly of claim 29, wherein the composition further comprises at least one of: a polymer, a plasticizer and a crosslinker.

38. The warhead assembly of claim 29, wherein said explosive material has a composition comprising:

| component | Min. Amount (weight %) | Max. Amount (Weight %) |
|---|---|---|
| RDX (4$\mu$) | 19.0 | 21.0 |
| RDX Class I | 4.0 | 6.0 |
| Ammonium Perchlorate | 29.0 | 32.0 |
| Aluminum | 32.0 | 35.0 |
| Poly BD | 4.44 | 4.44 |
| Dioctyl Adipate | 6.56 | 6.56 |
| Isophorone Diisocyanate | 0.45 | 0.45 |
| Lecithin | 0.30 | 0.50 |
| Triphenyl Bismuth | 0.01 | 0.30 |

39. The warhead assembly of claim 29, further comprising the warhead casing having a substantially ogive-shaped nose portion, and an interior surface extending from the aft end portion including a forward interior end surface defining an explosive payload receiving section; and the explosive material contained in the payload receiving section of the warhead casing and disposed along the interior surface.

40. The warhead assembly of claim 29, wherein the explosive material comprises a composition comprising 19–21 weight % 4$\mu$ RDX.

41. A warhead assembly comprising:

a penetrating warhead casing, said casing comprises an ogive-shaped end portion, and a substantially cylindrically-shaped aft end portion at an end of the warhead opposite from said nose portion, a bore formed in said aft end portion;

an aft closure ring fitted within said bore, and a vent disposed within said aft closure ring; and said casing filled to a predetermined level with an explosive material, said explosive material having a composition comprising in weight percent: 23.0–27.0% high explosives, 29.0–32.0% oxidizer, 32.0–35.0% metal fuel, 0.30–0.50% wetting agent, and 0.01–0.30% catalyst.

42. The warhead assembly of claim 41, wherein:

the high explosives include RDX (4$\mu$) and RDX Class1;

the oxidizer includes ammonium perchlorate;

the metal fuel includes aluminum;

the wetting agent includes lecithin; and the catalyst includes triphenyl bismuth.

43. The warhead assembly of claim 41, further comprising an interior surface extending from the aft end portion including a forward interior end surface defining an explosive payload receiving section; and the explosive material contained in the payload receiving section of the warhead casing and disposed along the interior surface.

44. The warhead assembly of claim 41, wherein said vent comprises at least one opening defining a vent opening area, said explosive material defining a total external explosive surface area, and the ratio of vent opening area to total external explosive area is approximately 0.27.

45. The warhead assembly of claim 41, wherein the composition further comprises at least one of: a polymer, a plasticizer and a crosslinker.

* * * * *